US005378338A

United States Patent [19]

Langon et al.

[11] Patent Number: 5,378,338

[45] Date of Patent: Jan. 3, 1995

[54] SUPERSTRUCTURE FOR A VERY HIGH POWER ELECTROLYSIS CELL FOR THE PRODUCTION OF ALUMINUM

[75] Inventors: Bernard Langon, Rives sur Fure; Christian Duval, La Fleche; Alain Vanacker, Beuvry la Foret, all of France

[73] Assignee: Aluminium Pechiney, Courbevoie, France

[21] Appl. No.: 106,711

[22] Filed: Aug. 16, 1993

[30] Foreign Application Priority Data

Aug. 20, 1992 [FR] France ..... 92 10272

[51] Int. Cl.[6] ..... C25C 3/10

[52] U.S. Cl. ..... 204/243 R; 204/286; 204/297 R

[58] Field of Search ..... 204/225, 243 R–247, 204/286–288, 297 R

[56] References Cited

U.S. PATENT DOCUMENTS

| | | | |
|---|---|---|---|
| 3,627,670 | 12/1971 | Duclaux | 204/225 X |
| 3,752,465 | 8/1973 | Siegmund | 204/286 X |
| 4,025,414 | 5/1977 | Vendramini | 204/297 R |
| 4,720,333 | 1/1988 | Duval et al. | 204/241 |
| 4,855,031 | 8/1989 | Zannini | 204/245 X |

FOREIGN PATENT DOCUMENTS

| | | |
|---|---|---|
| 0210111 | 1/1987 | European Pat. Off. . |
| 2147411 | 3/1973 | Germany . |
| 2263348 | 7/1974 | Germany . |

*Primary Examiner*—Donald R. Valentine

*Attorney, Agent, or Firm*—Dennison, Meserole, Pollack & Scheiner

[57] ABSTRACT

Superstructure for a very high power electrolysis cell for the production of aluminum using the Hall-Héroult process. The cell being formed of a heat-insulated metal casing of elongated parallelepipedic shape. The said superstructure comprising at least one rigid beam disposed along the long length of the casing, resting on supports, and supporting in particular the anodic frame structure to which are connected on the one hand the current risers coming from the preceding cell in the series and on the other hand the anode rods, characterized in that each rigid beam rests only upon supports placed between its ends, termed intermediate gantries. In that each anodic frame structure associated with each rigid beam includes electrical and mechanical connection or connectors to the anode completely fixed to the anodic frame structure and ensuring the contact and the clamping of each anode rod against it following lateral engagement and positioning of each rod in the corresponding connector.

18 Claims, 5 Drawing Sheets

SUPERSTRUCTURE FOR A VERY HIGH POWER ELECTROLYSIS CELL FOR THE PRODUCTION OF ALUMINUM

BACKGROUND OF THE INVENTION

FIELD OF THE INVENTION

The present invention concerns a superstructure for a very high power cell for the production of aluminium using to the Hall-Héroult process by the electrolysis of alumina in molten cryolite. This cell superstructure is designed to support the different devices connected thereto which are vital for the operation of the cell and are thus of necessity situated in its immediate environment, while taking up the least possible amount of space and causing minimum obstruction.

The superstructure of a modern electrolysis cell is formed by one or more horizontal beams made of steel, the ends of which are supported upon legs, and which support the devices connected thereto comprising the anodic current risers and the anodic frame structure formed by aluminium bars to which the anodes are connected, the cryolite and alumina feed systems (alumina reservoir, crust breaker, distributor-metering system), the mechanisms for controlling upward and downward movement of the anodes, and in many cases, ducts for gathering effluents, gas and dust emitted by the tank.

The legs rest upon the ends of the metal casing which forms the electrolysis cell in the true sense. This arrangement has the advantage of making space available at the two long sides of the cells by way of which operations of changing anodes are effected.

The present tendency is to provide for a constant increase in the unitary power of the cells which results in an increase in the length of the casing, which length may exceed 15 meters for very high power tanks operating at over 300 kA.

In this case the construction of the superstructure raises a difficult problem as it must have sufficient rigidity to:

- support with its own weight the anodes and all the devices connected to it as set out above,
- support the force necessary to break the crusts formed by solidified electrolyte and which resist the vertical movements of the anode,
- ensure that the anode-cathode distance (about 40 mm) is constant over the entire length of the cell as the procedure for regulating the cells requires extremely accurate positioning of the anodic plane with respect to the horizontal cathodic plane formed by the layer of liquid aluminium.

In order to do this the thickness and the height of the beams, and consequently the mass thereof are increased. The increase in height has repercussions upon the height of the buildings and thus upon cost. In consequence, this line of development very quickly becomes limited.

For high power cells which nevertheless operate at below 300 kA, a solution is to be found in the addition of supporting points or intermediate gantries between the legs at the ends supporting the horizontal beams, such as specified in EP-A-0210111 (U.S. Pat. No. 4,720,333) to form a superstructure with multiple supports or a multi-piered structure.

For very high power cells operating at over 300 kA this solution cannot really be applicable because of the impossibility of performing certain maneuvers, particularly during changing of the anodes, and the risk of accidents caused by the excessive obstruction along the long sides of the cell.

Indeed, with the increase in the number of anodes, but particularly with the increase in their size and therefore of their unitary mass, which exceeds 2 tons, new difficulties arise in achieving a good yield from the cells, which particularly call into question the multi-piered superstructure with legs at its ends and intermediate gantries such as described above. This superstructure has shown itself to be incompatible with certain integrated devices, rendering inaccessible, for example, electrical and mechanical connection systems, or connectors, of the anode rods onto the anodic frame structure.

Therefore, the connectors normally used on medium and high power electrolysis tanks ($1<300$ kA) are "straight entry" connectors such as those described in U.S. Pat No. 3,627,670 (FR-A-2039543) by which the positioning before clamping of the anode rod onto the anode frame structure is effected by movement of this rod, maintained in a vertical position, towards its location in the connector along a plane perpendicular to the plan of the anodic frame structure. With the increase in size of the anodes this manoeuvre for approaching the connectors near the support points, that is to say the legs at the ends and the intermediate gantries, becomes impossible as these supporting points are situated in the trajectory of the anodes.

Moreover, these "straight entry" connectors comprise a fixed part firmly attached to the anodic frame structure which ensures centring of the anode rod, and a removable part which ensures clamping and blocking of the rod against the anodic frame structure once it is in position. With regard to holding anodes the mass of which is in excess of 2 tonnes, the quality of the contact and the clamping of the anode rod against the anodic frame structure has to remain excellent in order to limit the difference in potential at the rod/frame interface, and also to avoid any sliding of the anode and thus any disturbance due to a local variation in the anode/cathode distance. In order to do this, the clamping pressure and therefore the size of the connectors, and particularly of their removable part, has to be increased considerably. During changing of the anode, hanging means need to be provided for temporarily holding those removable parts, the mass of which can reach 30 or 40 kg, thus increasing the risks of loss and obstruction in the working area.

Having regard to these disadvantages, the inventor has developed a new superstructure in combination with another type of anode connector for high power electrolysis cells, in order to:

- maintain sufficient rigidity of the horizontal beams despite the increase in the weight of the anodes and of certain devices connected thereto, and to do this without increasing the height of the superstructure, which would necessitate raising the height of the building,
- to effect anode changes without the difficulty resulting on the one hand from obstruction and risks of loss caused by the removable parts of the connectors, and on the other hand by the insufficiency of the multi-piered structure with the type of anode rod connection and to do this without elongation of the superstructure or increase in the centre distance between cells, and thus without modification of size at ground level in buildings.

SUMMARY OF THE INVENTION

During tests, it became apparent that the use of intermediate gantries could be preferable compared to that of legs at the ends and that 3, indeed 4 gantries judiciously sited between the ends of each central beam were sufficient, in the absence of legs at the ends, to retain sufficient rigidity of the superstructure once the bending stress and therefore stress of deformation remained acceptable for each pier.

By virtue of the limitation of the number of piers and thus of obstruction along the long sides of the cell the accessibility of the connectors to the large anodes was considerably improved but it was preferable to address the problem of bringing the anode shaft rod towards the connector at the level of the intermediate gantries.

This was solved by adopting a new method of connection by lateral engagement of the anode rods in their respective connector along a plane parallel to the anode frame structure, each connector moreover remaining completely fixed to the anodic frame structure, eliminating any risk of loss of clamping parts, which become fixed in place.

More precisely, the invention concerns a superstructure for a very high power electrolysis cell for the production of aluminium using the Hall-Héroult process, the tank being formed of a heat-insulated metal casing of elongated parallelepipedic shape, the superstructure comprising at least one rigid beam disposed along the long length of the casing, resting on supports, and supporting in particular the anodic frame structure to which are connected on the one hand the current risers coming from the preceding cell in the series and on the other hand the anode rods, characterised in that each rigid beam rests only upon supports placed between its ends, preferably at more than 50 cm from the ends, termed intermediate gantries, and in that each anodic frame structure associated with each rigid beam comprises means for electrical and mechanical connection or connectors to the anode completely fixed to the anodic frame structure and ensuring the contact and the clamping of each anode rod against it following lateral engagement and positioning of each rod in the corresponding connector.

DESCRIPTION OF THE DRAWINGS

In FIG. 1 the essential components of the electrolysis cell have been emphasised, namely the metal casing 1, the internal lining 2, the cathode 3 and the cathodic bar 4, the layer of liquid Al 5, the bath of molten cryolite 6 covered with a solidified crust 7, the anodes 8 suspended by rods 9 and fixed to the anodic frame structure 10 by means of connectors 14, as well as the superstructures formed by the two rigid beams 11 which support, in particular, the anodic frame structure 10, all of the anodes 8, the alumina distributor-metering device 12 the local storage silo 13 of which is often disposed between the two beams 11, as are the effluent gathering ducts which are not shown.

FIG. 2 illustrates a superstructure for a cell of a known type, and shows a schematic diagram of the contour of the upper rim 15 of the casing 1 as well as the rigid beams 11 which form the superstructure, the ends of which rest on legs 32 disposed at each head end of the tank while their centre is supported upon a central gantry 17 itself having 2 or 4 legs 18 which rest on the upper rim 15 of the casing at the central part thereof.

The method of connection of the anode rods by a connector 14 clamping the rod 9 of the anode against the anodic frame structure 10 after bringing towards and positioning of the rod maintained in a vertical position in a plane perpendicular to that of the anodic frame structure passing through the connector 14 should also be noted.

Figure 3:
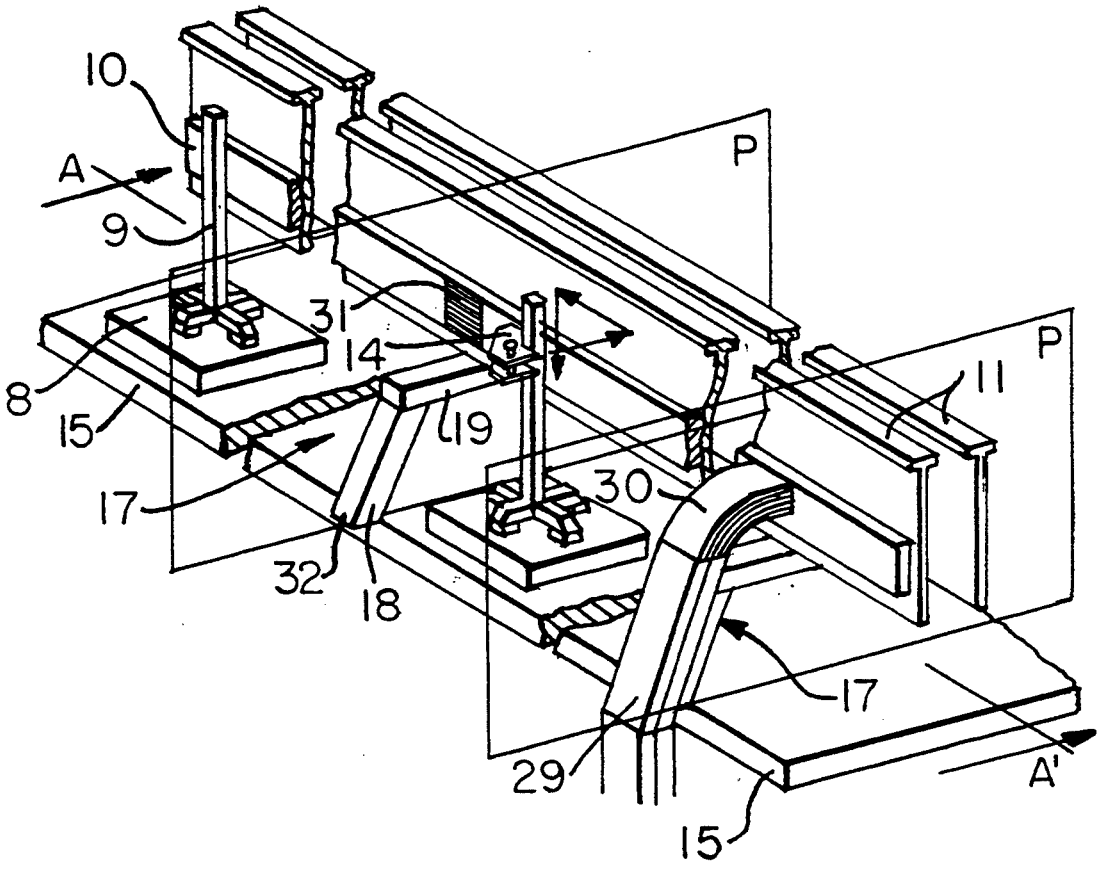
FIG. 3 represents the most common variants of tank superstructure according to the invention.

FIG. 3 represents an embodiment of a superstructure according to the invention comprising 2 rigid beams 11 with an I shaped profile disposed upon at least two intermediate gantries 17 each comprising a transversal supporting beam 19 resting on at least two legs 18. The transversal supporting beam shown in the form of tubular profile with a square section may also be formed by any solid profile, for example as an I, T or U. In the present case the legs 18 of the 2 intermediate gantries rest upon the upper rim 15 of the casing from which they are electrically isolated. This system of support has to take into account the expansion of the metallic casing during operation, in particular in the transverse direction, and thus it does not truly constitute a fixed point of support. It is therefore necessary to provide freedom of movement in respect of such support in the direction of expansion of the casing, that is to say in the general direction of the current passing through the potline which are disposed crosswise with respect to the axis of the line. In order to effect such protection it is therefore necessary to provide means permitting relative movement of the support with respect to the casing at the level of the rim edge 15 such as supports which slide or roll 32 like skates or rolling wheels. It is equally possible to obtain this protection with an articulated system, represented in FIG. 4, comprising, for each gantry 17 on one side a leg 18A articulated on the rim edge 15 about a fixed axis parallel to the main axis A-A' of the tank, and on the other side a mobile leg formed by a lever or rocker 18B articulated at one of its ends on the rim edge 15 about a fixed axis also parallel to the main axis of the tank and at its other end about a mobile axis common to that of the end of the transverse support beam 19 of the gantry.

Support of the legs 18 of the gantry can also be effected outside the casing on special elements, for example a support body or reinforced concrete pillars. This arrangement obviates the problems of electrical insulation and transverse expansion of the cell but reduces the space between the tanks.

If the conventional version of the longitudinal rigid beams 11 consists of I profiles, it is possible to advantageously replace each I profile with a mechanically welded assembly of two square, rectangular or circular section tubular profiles 11A, 11B kept parallel by struts which serve as supporting legs 11C in solid or tubular profile with square, rectangular or circular section. This configuration, shown in FIG. 4, ensures excellent rigidity and offers the advantage of leaving openings 27 between the supporting legs (11C) for the passage of mechanical and electrical linkages, in particular of equipotential crosspieces 28 for ensuring rigorous electrical and mechanical balance between the anodic frame structures 10 upstream and downstream of the same cell.

The invention also concerns the construction of a superstructure with rigid longitudinal beams 11 which are non-continuous, that is to say formed from at least two distinct portions, each resting on at least two intermediate gantries 17. This configuration (not shown) allows the limitation of the flexural constraints which apply to very long rigid beams 11, but above all simplification of construction, transport and installation of such beams. By using this method, the superstructure can even be formed by assembly of modular elements.

The support of the longitudinal continuous or non-continuous parts 11, 11B on the intermediate gantries 17 is generally by means permitting the absorbtion of slight relative movements of the supports of the beams on the gantry. A simple solution is to allow the supporting faces of the longitudinal beams 11 to freely rest on the transverse supporting beams 19 of the intermediate gantries.

Figure 1:
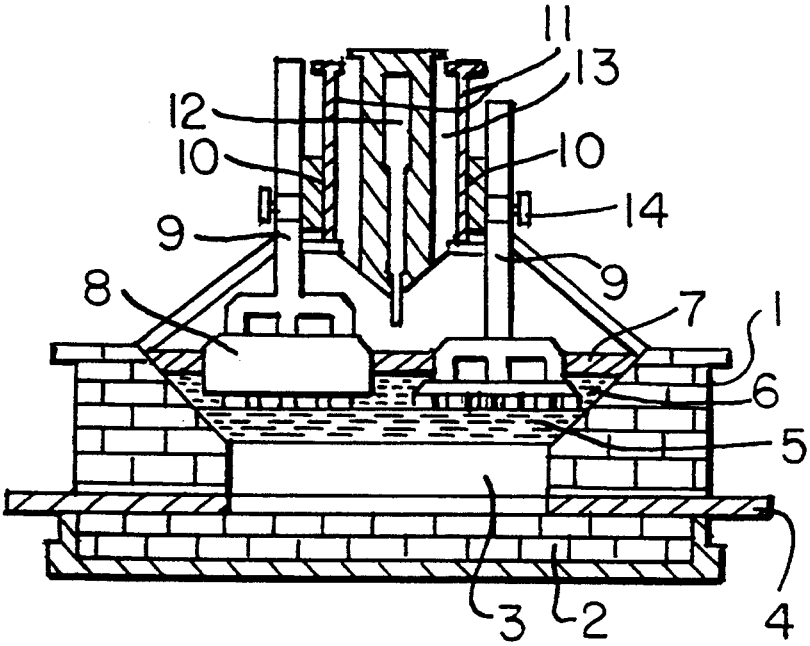
Fig. 1. (PRIOR ART)
FIG. 1 shows a cross section of the structure of an electrolysis tank.
Figure 2:
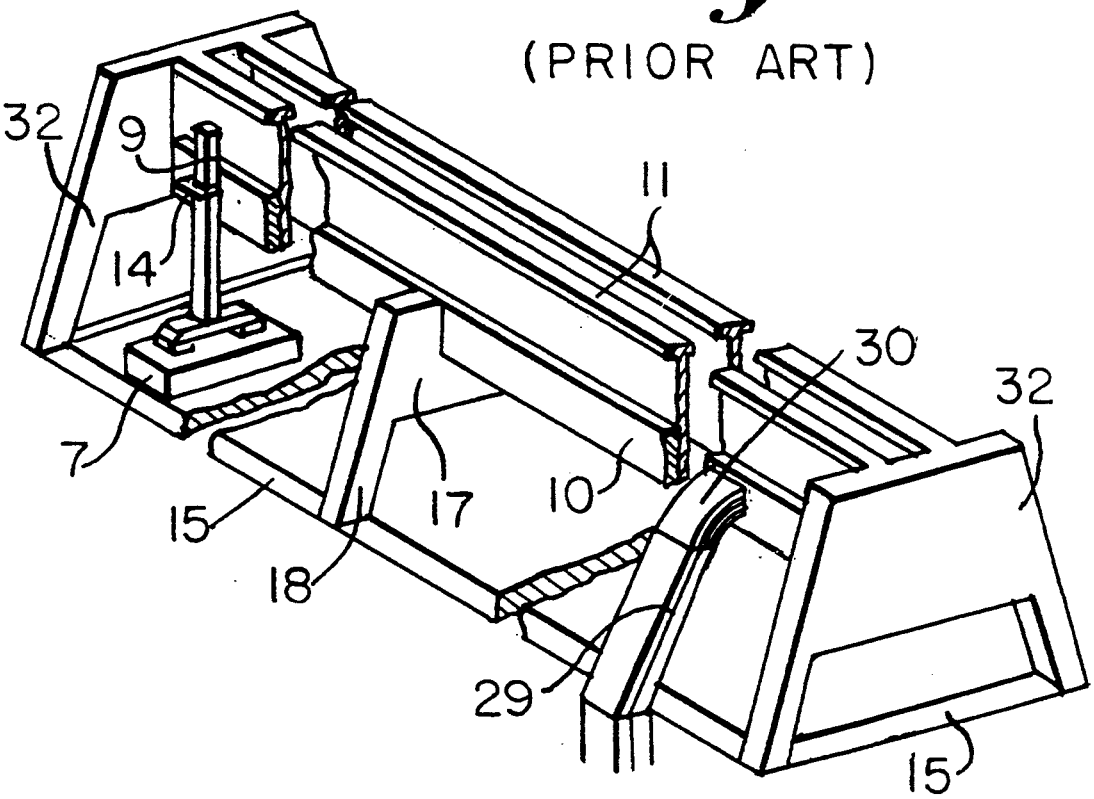
Fig. 2. (PRIOR ART)
FIG. 2 shows an example of a superstructure for a high power cell of a known type.
Figure 4:
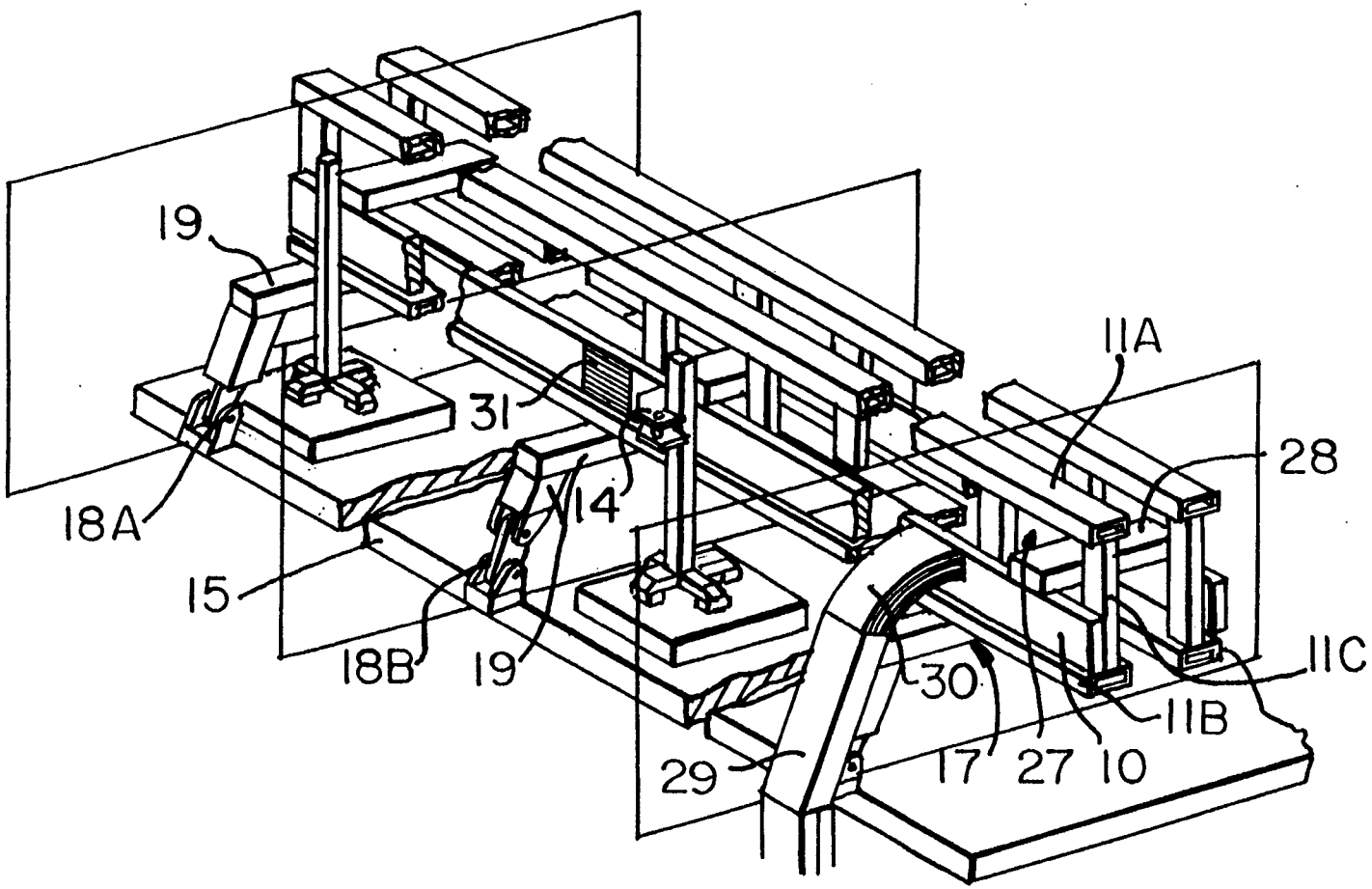
FIG. 4 represents a tank superstructure according to the invention.

It is advantageous, with regard to the positioning of the electrical circuits in the superstructure, and particularly of the anodic frame structures 10, that the aforementioned are positioned above the intermediate gantries as shown in FIGS. 3 and 4, rather than being sited in the transverse beams of the intermediate gantries as shown in FIG. 2. It should be noted that as with the longitudinal rigid beams 11, the anodic frame structures 10 which are very long can be constructed in two parts so as to distribute expansion on either side of the centre of the superstructure. An expansion joint, for example, a loop of aluminium straps or any other equivalent means is disposed between the two parts ensuring electrical contact.

Moreover, it is preferable to dispose the current input member 29 coming from the upstream cell to the right of the intermediate gantries 17 which is to say in the same vertical plane as that of the gantries, the flexible foils 30 which ensure electrical connection between the input member 29 and the anodic frame structure 10 being connected on to the frame in the hatched area so as to liberate the maximum amount of space for the operations of changing anodes along the long sides of the cell.

These arrangements of the principal elements of the superstructure are designed to ensure efficient service of the very power tanks and it is necessary to complete them by modification of the means of electrical and mechanical connection of the rods 9 of the anodes to the anodic frame structure 10 due to the unsuitability of the connectors for positioning operations and for retaining the large-sized anodes by clamping. The new connector 14 which allows positioning of the rods 9 of the anodes by lateral engagement in the connector housing provided for this purpose and completely fixed to the anodic frame structure integrated into the new superstructure efficiently solves the problems of positioning and clamping of rods of large anodes.

Figure 5:
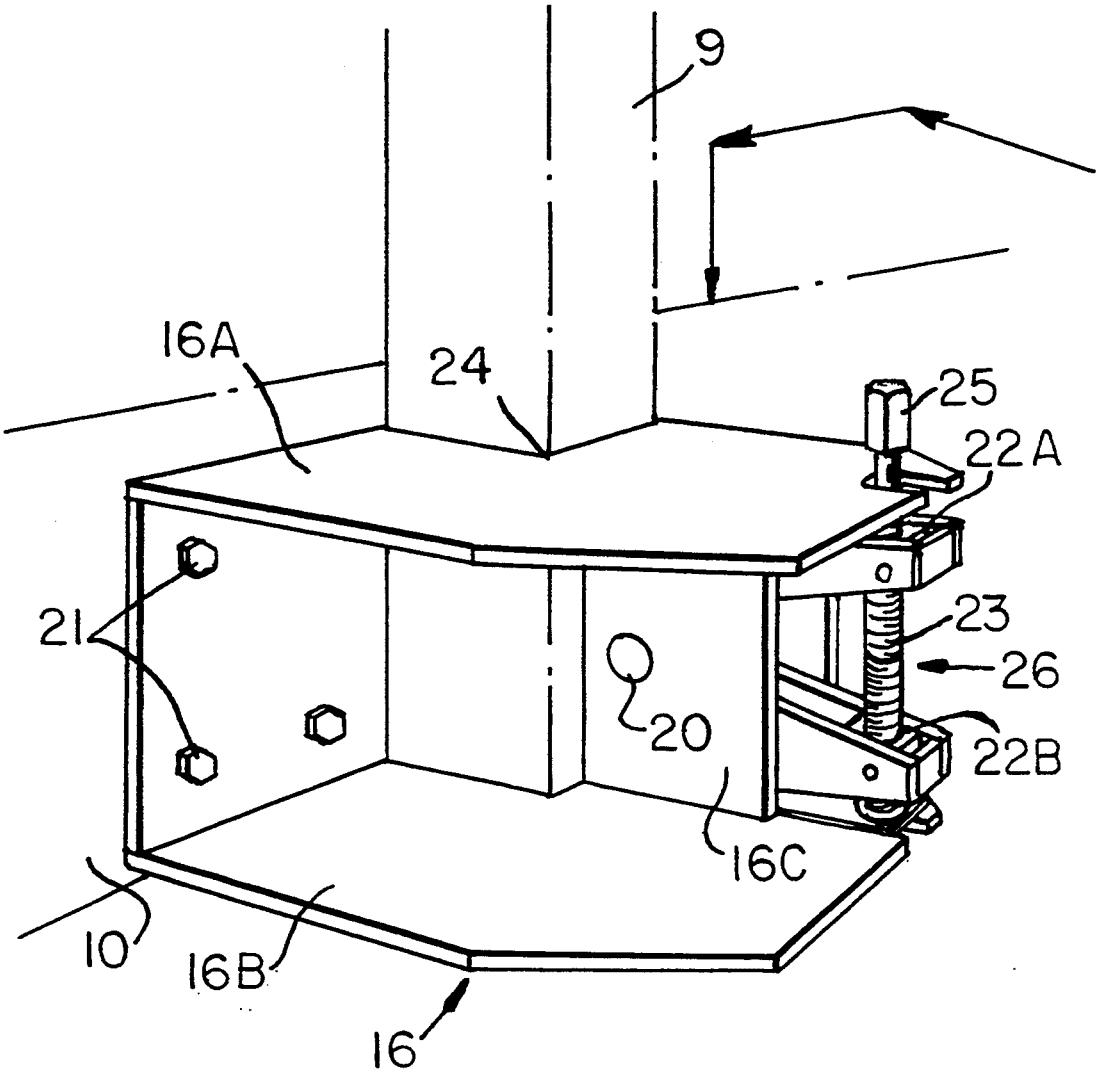
FIG. 5 represents a type of anode with lateral engagement according to the invention.

According to FIG. 5, this connector 14 is formed in particular by a metallic chassis 16 fixed to the anodic frame structure 10 by a bolt connection or any other rigid fixing means 21. This chassis is delimited by two parallel plates 16A, 16B and their struts 16C comprising a lateral recess which forms, together with the anodic frame structure 10, the housing 24 into which the rod 9 of the anode is placed. The latter, maintained in a vertical position, is firstly moved along a plane perpendicular to the anodic frame structure and at a distance of at least ½ the width of the anode away from the edge of the nearest intermediate gantry, then moved along a plane parallel to the anodic frame structure towards the lateral housing 24 of the connector where it is then lowered down towards the bath and positioned at the level required by the anodic plane. The anode rod is then clamped to the anodic frame structure using an appropriate clamping means fixed to the chassis 16 so that the chassis/clamping means assembly which forms the connector is completely fixed to the anodic frame structure.

Figure 6A:
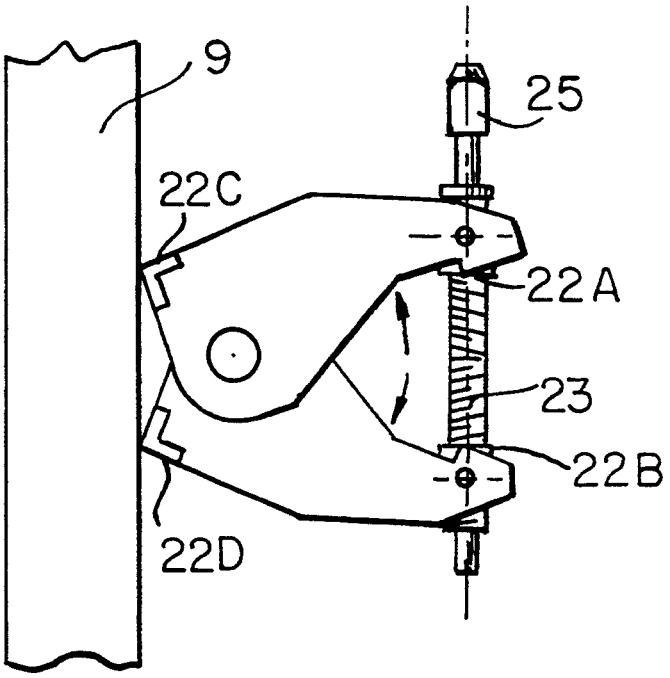
FIGS. 6A and 6B represent a type of anode connector with lateral engagement which, in combination with the new superstructure, constitutes the invention. In order to respect true proportions (width/length of the casing) part of the length of the superstructures has been truncated in FIGS. 2, 3 and 4.
Figure 6B:
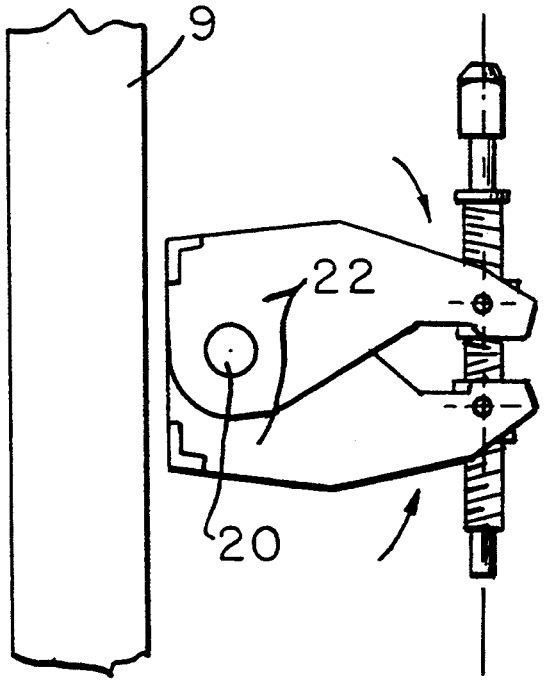

A preferred clamping means 26 such as that shown in FIGS. 5, 6A and 6B is formed in particular by two levers 22 articulated about a common shaft 20, mounted on the struts 16C of the chassis, the separation of which is regulated at their free ends by means of two nuts 22A, 22B and a screw embodying 2 portions having opposite threads 23 by the rotation of the screw head 25. Each lever head on the side of the fixed axis 20 is provided with a clamping piece or crosspiece 22C, 22D which comes to bear upon the whole width of the lever against the anode rod when the levers are separated according to the position shown in FIG. 6A.

In contrast, the bringing together of the levers as shown in FIG. 6B causes the disengagement of crosspieces 22C, 22D and the unclamping of the anode rod. It should be noted that as the axis of rotation 20 of the levers is fixed, the distance of the screw embodying two portions having opposite threads from the axis of rotation during the bringing together of the levers must not be opposed, and in order to achieve this, it is necessary to provide at the free ends of the levers, orifices of an oblong shape for the passage of the screw embodying two portions having opposite threads and of its nuts which move in translation.

Clamping means 26 other than those described above form part of the invention claimed once they are completely integrated into the chassis 16 permitting lateral entry of the anode rods into the connector 14 which is completely fixed to the anodic frame structure.

Finally, the invention makes it possible to take into account the bowing of the beams due to differential thermal expansion. The horizontal support beam 19 of the gantry is subject to temperature variations which are a function of the alumina coating of the anodes. The highest temperature is reached during changing of an anode in the vicinity,, of that particular beam, this changing bringing about the breakage of the solidified electrolytic crust, so that the electrolyte at about 930°–960° radiates directly upon the superstructure.

The thermal gradient between the upper and lower pans of the beam causes bowing thereof. If this bowing is incompatible with the regulation of the tank it is necessary to reduce the thermal gradient. Good expansion control makes it possible to simplify the points of support of the gantry on the casing if the expansion phenomena are similar.

To this end, one or more of the following solutions may be employed to act upon the different factors which cause bowing a). Materials. The beam may be formed by nickel steels, the expansion of which is half that of ordinary steel b). Removal heat by circulation of air. Heat can be removed by circulation of air inside or around the beam c). Removal of heat by Caloduc. Closed tubes containing a fluid at the limit of vapourisation temperature are disposed in contact with the lower part of the beam at one end and on the exterior of the tank at the other end. The heat of the exposed pan of the beam vapourises the liquid, the gas rises in the tube and condenses in the outer part, giving off heat.

d). Temperature balancing. A thermal bridge may be installed between the lower part of the beam and the upper pan thereof. It must be made from a material which a good thermal conductor such as aluminium.

e). Thermal screen. A reflective and/or insulating thermal screen installed around the beam protects the latter from occasional thermal radiation during changing of an anode.

The invention in the various embodiments described above overcomes one of the most serious obstacles to the production of tanks of over 300 kA capacity, the economic advantages of which are very attractive.

We claim:

1. Superstructure for a very high power electrolysis cell for the production of aluminium using the Hall-Heroult process, the cell being formed of a metallic casing (1) which is heat-insulated and of elongated parallelepipedic shape, said superstructure comprising at least one rigid beam (11) disposed along the long length of the casing, resting on supports, and supporting in particular the anodic frame structure (10) to which are connected on the one hand the current risers (29) coming from the preceding cell in the series and on the other hand the anode rods (9), characterised in that each rigid beam (11) rests solely upon supports placed between its ends, termed intermediate gantries (17), and in that each anodic frame structure (10) associated with each rigid beam comprises means for electrical and mechanical connection or connectors (14) to the anode completely fixed to said anodic frame structure and ensuring the contact and the clamping of each anode rod against it following lateral engagement and positioning of each rod in the corresponding connector, and legs (18) of each intermediate gantry rest on the rim of the casing by means permitting relative displacement of the support in relation to the casing.

2. Superstructure according to claim 1, characterised in that each intermediate gantry (17) comprises a transverse supporting beam (19) resting on at least 2 legs (18).

3. Superstructure according to claim 2, characterised in that the transverse supporting beam (19) as well as the legs (18) are made of square, rectangular or circular section tubular profile.

4. Superstructure according to claim 2, characterised in that the transverse supporting beam (19) as well as the legs (18) are solid I, T or U shaped profiles.

5. Superstructure according to and of claims 1 to 4, characterised in that the means permitting relative displacement of the support in relation to the casing are rolling or sliding supports (31).

6. Superstructure according to any of claims 1 to 4, characterised in that the means permitting relative displacement of the support in relation to the casing are an articulated system comprising on the hand an articulated leg (18A) articulated upon the edge of the rim (15) about a fixed axis, and on the other hand a mobile leg formed by a lever or rocker (18B) articulated at one end upon the edge of the rim and at its other end about an axis common to the end of the transverse supporting beam (19).

7. Superstructure according to any of claims 1 to 4, characterised in that the support of the legs (18) of each intermediate gantry is effected on the exterior of the casing upon specialised members.

8. Superstructure according to any of claims 1 to 4, characterised in that the rigid beams (11) which are longitudinal are solid I profiles.

9. Superstructure according to any of claims 1 to 4, characterised in that each rigid beam (11) which is longitudinal is formed by two solid or tubular profiles (11A, 11B) of square, rectangular or circular section, kept parallel by braces or supporting legs (11C) of solid or tubular profile of square, rectangular or circular section.

10. Superstructure according to any of claims 1 to 4, characterised in that the rigid beams (11) which are longitudinal are non-continuous and formed of at least two portions each resting upon at least two intermediate gantries (17).

11. Superstructure according to any of claims 1 to 4, characterised in that the current input members (29) coming from the upstream tank as well as the flexible foils (30) ensuring connection of these input members (29) and the anodic frame structure (10) are disposed in the vertical plane P perpendicular to the main axis AA' of the tank passing through each intermediate gantry.

12. Superstructure according to any of claims 1 to 4, characterised in that the transverse supporting beam (19) of each intermediate gantry comprises at least one means of protection against thermal radiation from the electrolyte bath.

13. Superstructure according to claim 1, characterised in that the anode connectors (14) which are completely fixed to the anodic frame structure, (10) are formed in particular of a metallic chassis (16) fixed to the anodic frame structure, to the interior of which is fixed a clamping means (26) for the anode rods.

14. Superstructure according to claim 13, characterised in that the chassis (16) which is fixed to the anodic frame structure by rigid fixing means (21) delimited by two parallel plates (16A, 16B) and their struts (16C) comprise a lateral recess which together with the anodic frame structure forms the housing (24) for the anode rod.

15. Superstructure for a very high power electrolysis cell for the production of aluminium using the Hall-Heroult Process, the cell being formed of a metallic casing (1) which is heat-insulated and of elongated parallelepipedic shape, said superstructure comprising at least one rigid beam (11) disposed along the long length of the casing, resting on supports, and supporting in particular the anodic frame structure (10) to which are connected on the one hand the current risers (29) coming from the preceding cell in the series and on the other hand the anode rods (9), characterised in that each rigid beam (11) rests solely upon supports placed between its ends, termed intermediate gantries (17), and in that each anodic frame structure (10) associated with each rigid beam comprises means for electrical and mechanical connection or connectors (14) to the anode completely fixed to said anodic frame structure and ensuring the contact and the clamping of each anode rod against it following lateral engagement and positioning of each rod in the corresponding connector, the clamping means (26) is formed by two levers (22) articulated upon a common axis (20) fixed to the struts (16C) of the chassis, the heads of which, on the side of the fixed axis (20), are provided with fixing members or crosspieces (22C, 22D) coming to bear against the rod (9) of the anode when the two said levers are separated.

16. Superstructure according to claim 15, characterised in that the separation of the levers is controlled at their free end (22A, 22B) by means of 2 nuts (22A, 22B) and by a screw embodying two portions having opposite threads (23).

17. Superstructure according to claim 15, characterised in that the anode connectors (14) which are completely fixed to the anodic frame structure, (10) are formed in particular of a metallic chassis (16) fixed to the anodic frame structure, to the interior of which is fixed a clamping means (26) for the anode rods.

18. Superstructure according to claim 17, characterised in that the separation of the levers is controlled at their free end (22A, 22B) by means of 2 nuts (22A, 22B) and by a screw embodying two portions having opposite threads (23).

* * * * *